US005320361A

United States Patent [19]

Hellerman

[11] Patent Number: 5,320,361

[45] Date of Patent: Jun. 14, 1994

[54] TOY DISCUS

[75] Inventor: Lee H. Hellerman, New York, N.Y.

[73] Assignee: Marvlee, Inc., North Lindenhurst, N.Y.

[21] Appl. No.: 997,021

[22] Filed: Dec. 28, 1992

[51] Int. Cl.[5] ..... A63H 27/00

[52] U.S. Cl. ..... 273/424

[58] Field of Search ..... 273/424, 425; 446/46–48

[56] References Cited

U.S. PATENT DOCUMENTS

| | | | |
|---|---|---|---|
| 3,710,505 | 1/1973 | Linenfelser | 273/424 X |
| 3,724,122 | 4/1973 | Gillespie, Sr. | 273/424 X |
| 4,023,805 | 5/1977 | Sherrill | 273/424 |
| 4,132,029 | 1/1979 | Thompson et al. | 273/424 X |
| 4,196,540 | 4/1980 | Hembree et al. | 273/424 X |
| 4,820,230 | 4/1989 | Richards | 446/48 |

*Primary Examiner*—Paul E. Shapiro

*Attorney, Agent, or Firm*—Fiddler Levine & Mandelbaum

[57] ABSTRACT

A toy flying discus is fabricated from a form sustaining, resilient, plastic foam material having a density which enables the discus to have an aerodynamic profile and sufficient mass to achieve distant flight with minimal launching force and to have sufficient resilience to absorb impact forces thereby preventing damage to objects which it contacts. The surface of the discus is absorbent to blend applied pigments for achieving an aesthetically pleasing appearance.

2 Claims, 2 Drawing Sheets

FIG. 1
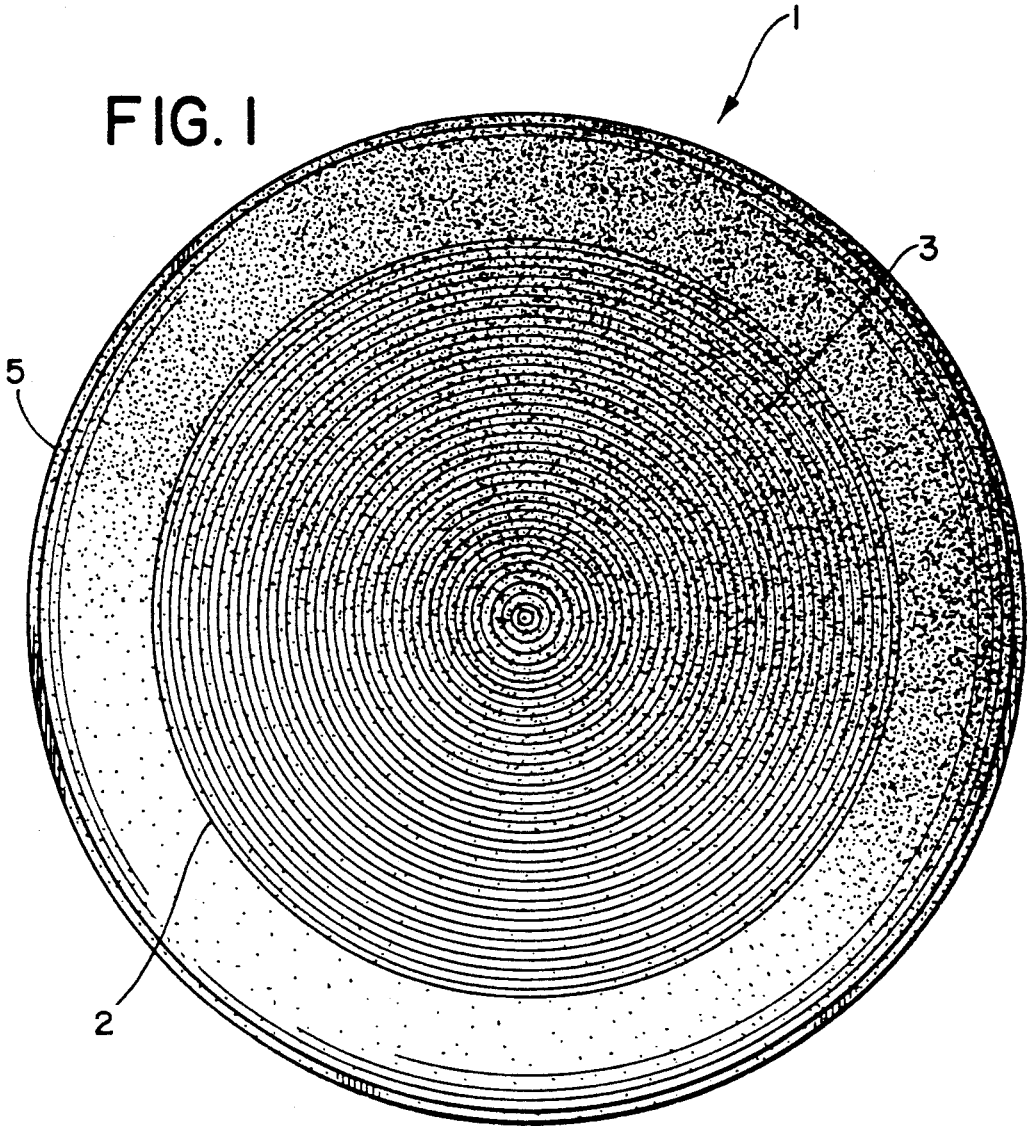
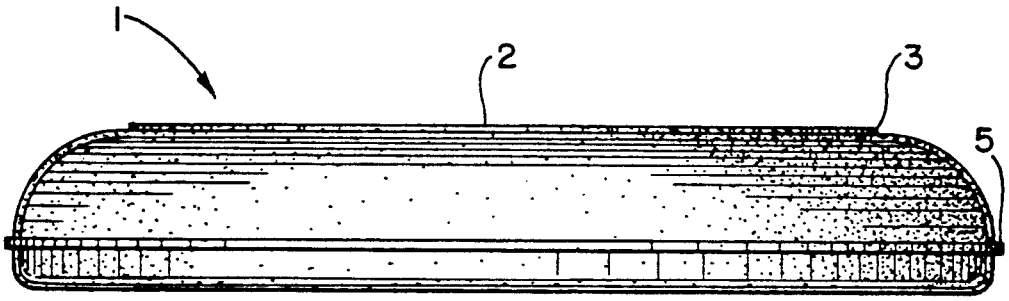
FIG. 2

FIG. 3
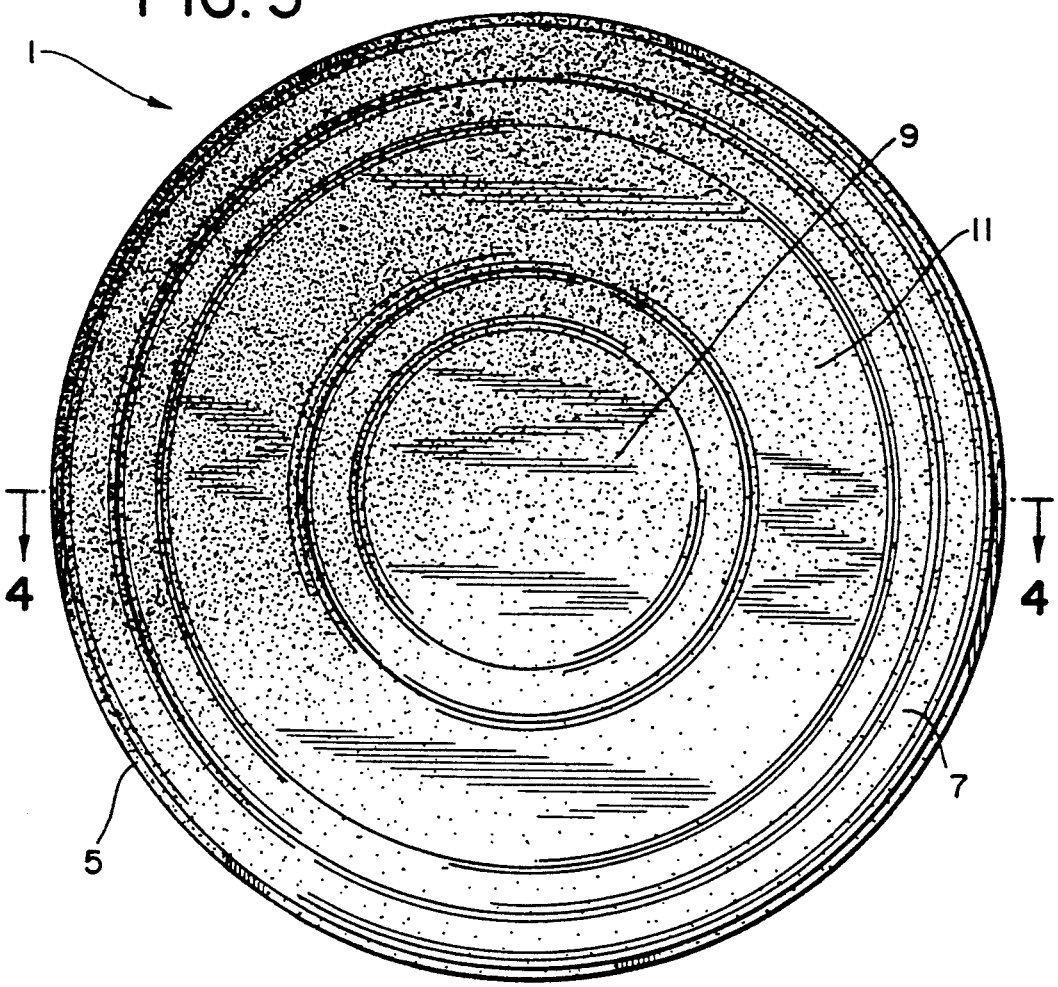
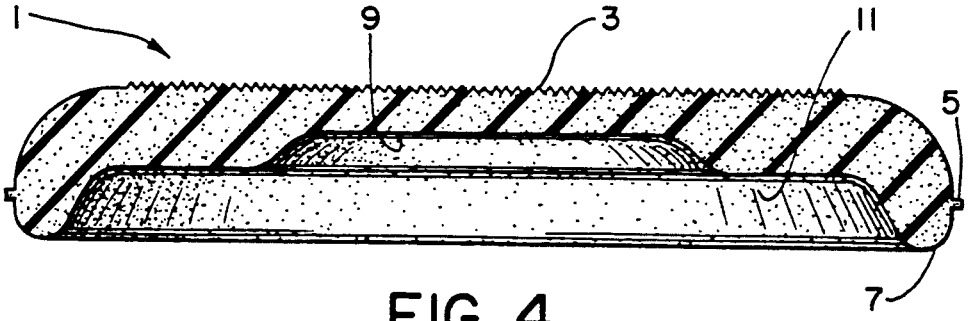
FIG. 4

TOY DISCUS

BACKGROUND OF THE INVENTION

This invention relates to a toy discus of the type which can be used for playing a game of catch. More specifically, the invention relates to a toy discus which can be launched by a flick of the wrist to travel substantial distances, through the air along a curved flight path, for reaching a catcher at a desired position.

It is known in the art to fabricate a toy discus from a substantially rigid plastic material in the shape of a hollow dish. The walls of such toy discusses must be kept relatively thin to keep their overall weight low so as to minimize the possibility of injury to a person who may be hit by the flying toy. Too little weight in a toy discus interferes with its ability to overcome air resistance and limits the potential flight distance of the toy.

It is also known in the prior art to employ a toy discus made of a soft fabric material. Such toy discusses require that their circumferences have weights sewn into them in order to provide the necessary mass for enabling flight of the discus.

The use of rigid materials and/or weights in toy discusses makes them potentially injurious to persons and objects. For example, prior art toy discusses are wholly unsuitable to use indoors where there may be breakable objects such as windows or mirrors which cannot withstand the impact of a rigid toy.

SUMMARY OF THE INVENTION

The aforementioned disadvantages of the prior art are overcome by the invention which provides for a toy discus made of a semi-flexible foam material having sufficient resilience to absorb the force of impact, sufficient density and weight to enable distant flight, and sufficient rigidity to maintain an aesthetically pleasing appearance and shape. More specifically, the present invention is directed to a toy discus fabricated from a foam plastic material molded into a circular shape having a substantially flat top, an outwardly and downwardly domed circumference, and an inwardly and upwardly stepped underside, and which can have a circumferential ridge radially extending from the circumference thereof, a weight to diameter ratio of 0.25 to 0.40 ounces per inch, a diameter of approximately 10 inches and a uniformly distributed mass resulting in a total weight of from 2.5 to 4.0 ounces, and which can be colored with at least two different pigments applied to adjacent regions of the outer surface thereof, the plastic material being absorbent to cause the pigments to blend along their juncture to form a region of color resulting from the mixture of the pigments within the foam material, wherein the foam plastic material is resilient for deforming upon impact with a rigid object and being restored to its shape, before impact, after separation from the object.

It is therefore an object of the invention to provide a toy discus which is resilient to absorb the force of impact.

Another object of the invention is to provide a toy discus having sufficient mass to enable distant flight without being damaging to objects with which it impacts.

Still another object of the invention is to provide a toy discus which is aesthetically pleasing in appearance.

A further object of the invention is to provide a toy discus which can absorb a pigment applied to its surface to provide an attractive appearance.

A still further object of the invention is to provide a discus having a surface which can absorb pigments of different colors and can blend them to display other colors derived from the mixing of the original colors.

Other and further objects of the invention will be apparent from the following drawings and description of a preferred embodiment of the invention in which like reference numerals are used to designate like parts in the various views.

DESCRIPTION OF THE DRAWINGS

FIG. 1 is a top plan view of the preferred embodiment of the invention.

FIG. 2 is a side elevation view of the preferred embodiment of the invention.

FIG. 3 is a bottom plan view of the preferred embodiment of the invention.

FIG. 4 is a side sectional elevation view of the preferred embodiment of the invention taken through line 4—4 of FIG. 3.

DESCRIPTION OF THE PREFERRED EMBODIMENT

Referring now to FIG. 1 of the drawings, there is shown a toy discus 1 which is formed by filling a mold with the components of a form sustaining, resilient, porous foam plastic material, e.g. polyurethane. The foam material is selected to have a density such that a discus having a diameter of 10 inches and a height of 1½ inches will weigh approximately between 2.5 and 4.0 ounces. That is, the ratio of weight to diameter will be between 0.25 and 0.40 ounces per inch.

The discus 1 has a substantially flat top 2, as seen in the view of FIG. 2, into which there are molded closely spaced, shallow, circular ridges and grooves 3. In the preferred embodiment of the invention, which is approximately 10 inches in diameter, the flat top section has a diameter of approximately 7½ inches. The exterior of the discus 1 is outwardly and downwardly domed from the outer circumference of the flat portion 2 toward the bottom of the discus 1. The discus 1 has a circumferential ridge 5 occupying a plane transverse to the axis of the discus.

In fabricating the discus 1, a two part mold is opened, filled with the components of the foam material, and closed to allow the components to cure to form a foam which expands to fill the mold cavity. The circumferential ridge 5 defines the seam formed at the juncture of the edges of the mold parts when they are closed.

Beneath the circumferential ridge 5, the discus extends downwardly, inwardly, and then upwardly to form a rounded circular bottom lip 7 as best seen in FIG. 4.

The bottom profile of the discus tapers inwardly and upwardly in steps as best seen in FIGS. 3 and 4. The underside of the discus 1 has a central flat circular center area 9 of approximately four inches in diameter in the preferred embodiment of the invention. A flat circular margin 11, concentric with the circular surface 9 has an inner diameter radially offset from the outer diameter of the central surface 9 by approximately 1 inch and a radial width of approximately 1 inch.

The surface of the foam is porous to receive and absorb a coating of a pigmented material, e.g., a paint or dye, and to allow the coloring material absorbed into the surface of any region of the discus to bleed laterally along the surface into adjacent regions without substantial vertical absorption into the interior of the discus. This enables the discus to be colored with two or more different overlapping colors with the result that adjacent colors are laterally blended in the regions where the colors are joined. For example, referring to FIG. 1, the portion of the discuss beginning at approximately the 10 o'clock position and continuing, clockwise, to approximately the 4 o'clock position, may have one coloring pigment applied to it and the half of the discus beginning at approximately 4 o'clock and continuing clockwise to approximately 10 o'clock may have a different coloring pigment applied. A gradual blend of the two colors takes place along a region of the surface of the discus where the two colors meet, that is, extending diametrically from an arc on the circumference of the discus between the 9 and 10 o'clock positions across the center of the discus to an arc on the circumference between the 3 and 4 o'clock positions.

The blend is very smooth and gradual and leaves no specific line of demarcation between the different colors. For example, the 10 o'clock to 4 o'clock half of the discus may be colored with a red pigment and the 4 o'clock to 10 o'clock half may be colored with a yellow pigment. A region of orange will appear along a diameter of the discus having an undefined width. That is, there is no sharp demarcation where the yellow turns to orange or where the orange turns to red. This results in an aesthetically pleasing appearance both when the discus is stationary and when it is spinning during flight.

The profile of the discus and its uniformly distributed mass give it the necessary density and aerodynamic characteristics to achieve distant flight with minimal imparted force. Yet, should the discus impact with a breakable object, e.g., glass in a mirror or window, it will bounce off the object without causing any damage.

The discus of the invention, when colored with an appropriate choice of pigments, has a pleasing appearance. Moreover, the discus appears to be rigid. When it impacts a hard surface with sufficient force, it is momentarily deformed to absorb the impact of the force, but is quickly restored to its original shape due to the inherent resiliency of the foam material from which the discus is fabricated.

It is to be appreciated that the foregoing description is of a preferred embodiment of the invention to which alterations and modifications may be made without departing from the spirit and scope of the invention which is defined in the following claims.

What is claimed is:

1. A toy discus comprising a foam plastic material molded into a circular shape having a substantially flat top, an outwardly and downwardly domed circumference, and an inwardly and upwardly stepped underside, said discus further comprising two differently colored pigments applied to adjacent regions of the outer surface thereof, said plastic material surface being absorbent to cause the pigments to blend along their juncture to form a region of color resulting from the mixture of the pigments within the foam material.

2. A throwing toy comprising a foam plastic material molded into a shape having a profile suitable for throwing and comprising two differently colored pigments applied to adjacent regions of the outer surface thereof, said plastic material surface being absorbent to cause the pigments to blend along their juncture to form a region of color resulting from the mixture of the pigments within the foam material.

* * * * *